US009596553B2

(12) United States Patent
Devantier et al.

(10) Patent No.: US 9,596,553 B2
(45) Date of Patent: Mar. 14, 2017

(54) APPARATUS AND METHOD FOR PERFORMING AN AUDIO MEASUREMENT SWEEP

(71) Applicant: Harman International Industries, Inc., Stamford, CT (US)

(72) Inventors: Allan Devantier, Newhall, CA (US); Sean Hess, Los Angeles, CA (US)

(73) Assignee: Harman International Industries, Inc., Stamford, CT (US)

( * ) Notice: Subject to any disclaimer, the term of this patent is extended or adjusted under 35 U.S.C. 154(b) by 234 days.

(21) Appl. No.: 14/335,461

(22) Filed: Jul. 18, 2014

(65) Prior Publication Data

US 2015/0023509 A1 Jan. 22, 2015

Related U.S. Application Data

(60) Provisional application No. 61/847,827, filed on Jul. 18, 2013.

(51) Int. Cl.
*H04R 29/00* (2006.01)
*H04R 3/00* (2006.01)

(52) U.S. Cl.
CPC ..... *H04R 29/001* (2013.01); *H04R 3/007* (2013.01); *H04R 2430/03* (2013.01)

(58) Field of Classification Search
CPC .. H04R 29/001; H04R 3/007; H04R 2430/03; G01R 27/28
USPC ..... 381/56, 58; 702/66, 89, 109, 110; 324/76.19, 312, 192
See application file for complete search history.

(56) References Cited

U.S. PATENT DOCUMENTS 6,760,451 B1 * 7/2004 Craven ..... H03G 5/005 381/59
7,027,940 B2 * 4/2006 Iannuzzi ..... G01R 27/28 324/312
7,804,963 B2 * 9/2010 Thomas ..... H04R 27/00 379/202.01
2005/0207592 A1 * 9/2005 Sporer ..... H04S 7/30 381/94.2
2006/0100809 A1 * 5/2006 Yoneda ..... G01H 5/00 702/109
2011/0274281 A1 * 11/2011 Brown ..... H04R 3/04 381/59

(Continued)

OTHER PUBLICATIONS

Stan et al, "Comparison of different impulse response measurement techniques", Dec. 2, 2002.*

(Continued)

*Primary Examiner* — David Ton
(74) *Attorney, Agent, or Firm* — Brooks Kushman P.C.

(57) ABSTRACT

In at least one embodiment, an apparatus for performing an audio measurement is provided. The apparatus includes a controller that is programmed to generate an audio test signal based on a first frequency range that comprises a first noise spectrum, a second frequency range that comprises a second noise spectrum, and a third frequency range that comprises a third noise spectrum and to transmit the audio test signal to an audio device that generates an audio response signal responsive to the audio test signal. The controller is further programmed to receive the audio response signal and to determine audio related characteristics for the audio device in response to the audio response signal.

18 Claims, 2 Drawing Sheets

(56) References Cited

U.S. PATENT DOCUMENTS

| | | | | |
|---|---|---|---|---|
| 2012/0134502 | A1* | 5/2012 | Kanishima | H04R 29/001 381/56 |
| 2012/0158809 | A1* | 6/2012 | Yamamoto | H04R 3/04 708/300 |
| 2012/0166123 | A1* | 6/2012 | Hino | G01R 27/28 702/89 |
| 2014/0010379 | A1* | 1/2014 | Wellman | H04R 29/00 381/58 |
| 2014/0161280 | A1* | 6/2014 | Nackvi | H04S 7/301 381/98 |

OTHER PUBLICATIONS

Olson, "Swept sine vs White Gaussian Noise", May 6, 2005.*
Farina, "Simultaneous measurement of impulse response and distortion with a swept-sine technique", Audio Engineering Society (AES), Presented at the 108th Convention, Paris, France, Feb. 19-22, 2000, 24 pages.
Farina, "Advancements in impulse response measurements by sine sweeps", Audio Engineering Society (AES), Presented at the 122nd Convention, Vienna, Austria, May 5-8, 2007, 21 pages.

* cited by examiner

APPARATUS AND METHOD FOR PERFORMING AN AUDIO MEASUREMENT SWEEP

CROSS-REFERENCE TO RELATED APPLICATIONS

This application claims the benefit of U.S. provisional Application No. 61/847,827 filed on Jul. 18, 2013, the disclosure of which is incorporated in its entirety by reference herein.

TECHNICAL FIELD

Aspects as disclosed herein generally relate to an apparatus and method for performing an audio measurement sweep of an audio system.

BACKGROUND

It is known to perform various sweeps to measure an impulse response of an audio system. One method for measuring an impulse response is set forth in "Simultaneous Measurement of Impulse Response and Distortion with a Swept-Sine Technique," Angelo Farina, Audio Engineering Society (AES), Presented at the 108$^{th}$ Convention 2000 Feb. 19-22, Paris, France. Improvements to the method are set forth in "Advancements in Impulse Response Measurements by Sine Sweeps," Angelo Farina, Audio Engineering Society (AES), Convention Paper 7121, Presented at the AES 112nd Convention, 2007 May 5-8, Vienna, Austria.

SUMMARY

In at least one embodiment, an apparatus for performing an audio measurement is provided. The apparatus includes a controller that is programmed to generate an audio test signal based on a first frequency range that comprises a first noise spectrum, a second frequency range that comprises a second noise spectrum, and a third frequency range that comprises a third noise spectrum and to transmit the audio test signal to an audio device that generates an audio response signal responsive to the audio test signal. The controller is further programmed to receive the audio response signal and to determine audio related characteristics for the audio device in response to the audio response signal.

In at least another embodiment, a computer-program product embodied in a non-transitory computer read-able medium that is programmed to perform an audio measurement is provided. The computer-program product comprising instructions to generate an audio test signal based on at least a first frequency range of a white noise spectrum and to transmit the audio test signal to an audio device that generates an audio response signal responsive to the audio test signal. The computer-program product further comprises instructions to receive the audio response signal; and to determine audio related characteristics for the audio device in response to the audio response signal.

In at least another embodiment, an apparatus including an audio device is provided. The audio device is programmed to generate an audio response signal responsive to an audio test signal that is based on a first frequency range that comprises a first noise spectrum, a second frequency range that comprises a second noise spectrum, and a third frequency range that comprises a third noise spectrum. The audio device is further programmed to transmit the audio response signal to a controller that determines audio related characteristics for the audio device in response to the audio response signal.

BRIEF DESCRIPTION OF THE DRAWINGS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

DETAILED DESCRIPTION

Figure 1:
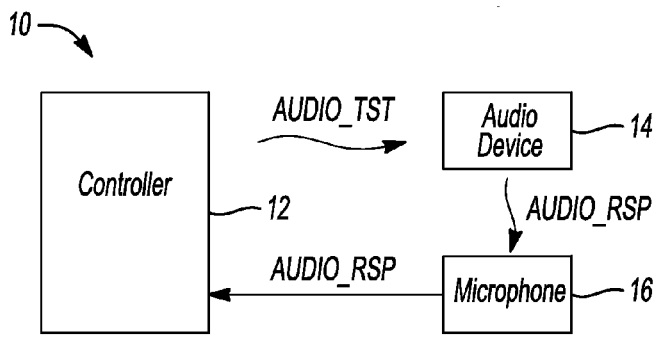
FIG. 1 depicts an apparatus for performing an audio measurement sweep in accordance to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The embodiments of the present disclosure generally provide for a plurality of circuits or other electrical devices. All references to the circuits and other electrical devices and the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired.

It is recognized that any circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices as disclosed herein may be configured to execute a computer-program that is embodied in a non-transitory computer readable medium that is programmed to perform any number of the functions as disclosed herein.

In general, a measurement sweep of an audio signal includes a pink power spectral density (e.g., a log sweep) over a useable frequency band of an audio device under test. The measurement sweep of the audio signal includes a white power spectral density (e.g., a linear sweep). The measurement sweep of the audio signal includes a red power spectral density (e.g., a −3 dB/octave power spectral density). The embodiments disclosed herein generally provide for an apparatus and method for providing an audio test signal that takes into account each of the pink power spectral density, the white power spectral density, and the red power spectral density. The audio test signal is transmitted to the audio device for testing the same. The audio device transmits an audio response signal in response to the audio test signal for analysis. The generation of the audio test signal and subsequent transmission to the audio device and playback thereof enables a user to understand the manner in which the audio device outputs audio data in various conditions (e.g., speaker in a room, concert venue, vehicle, etc.). By understanding the audio response of the audio device under a particular condition via the audio test signal, the user may take steps to equalize the audio device to obtain the desired audio output for that particular condition.

The embodiments provided may simultaneously improve the quality of time and frequency domain characterizations of the audio device under test while protecting the audio device from over-excursion. Over excursion generally occurs when a loudspeaker cone or dome is driven to various mechanical limits. This condition may damage the loudspeaker. Over-excursion may also occur when the loudspeaker is used below its intended range (e.g., at low frequencies). Conventional methods may compromise the accuracy of the time domain measurement for the accuracy of the frequency domain measurement and vice-versa. In addition, conventional methods may sacrifice accuracy of the time domain measurement to protect the audio device under test from over-excursion. The embodiments provided herein may improve the accuracy of both the frequency domain and time domain measurements of the audio device under test while keeping the crest factor of the stimulus at the lowest possible value (i.e., 3 dB) and may maximize the signal to noise ratio for the shortest possible measurement time. Crest factor is generally the ratio between a root mean square (RMS) value of the stimulus and a peak value of the stimulus. Generally, the lower the better. Log sweeps typically have a crest factor of about 3 dB.

FIG. 1 depicts an apparatus 10 for performing an audio measurement sweep in accordance to one embodiment. The apparatus 10 generally includes a controller 12, an audio device 14, and a microphone 16. In general, the controller 12 is configured to transmit a signal AUDIO_TST (or audio test signal) to the audio device 14. The audio device 14 is configured to generate and transmit a signal AUDIO_RSP (or audio response signal) in response to the signal AUDIO_RSP. The microphone 16 is configured to receive the signal AUDIO_RSP and to provide an electrical signal that is indicative of audio data on the signal AUDIO_RSP to the controller 12. It is recognized that the microphone 16 may be positioned separate from the controller 12 or may be positioned on the controller 12.

In general, the controller 12 is configured to generate the signal AUDIO_TST and to transmit the same to the audio device 14 for purposes of evaluating the output (e.g., the signal AUDIO_RSP) of the audio device 14. This condition enables a user to determine the manner in which the audio device 14 outputs audio data under a particular condition. For example, the audio device 14 may be, but not limited to, a speaker that is positioned in a room, concert venue, vehicle, etc. By controlling the audio device 14 to playback audio data in accordance to the signal AUDIO_TST, the user is able to ascertain or assess the manner in which the audio device 14 outputs the audio data under that particular condition. This condition enables the user to determine the manner in which the audio device 14 transmits audio data in both the frequency domain and the time domain.

Figure 2:
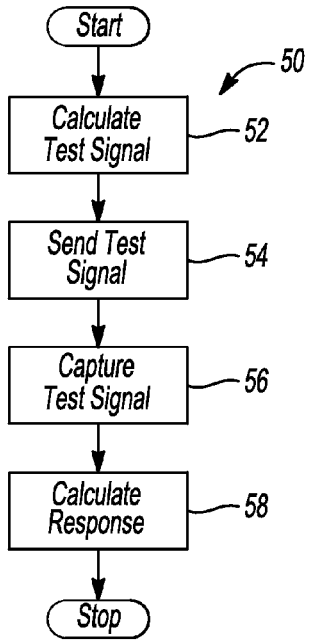
FIG. 2 depicts a method for performing the audio measurement sweep for the apparatus as set forth in FIG. 1.

FIG. 2 depicts a method 50 for performing the audio measurement sweep for the apparatus 10 as set forth in FIG. 1.

In operation 52, the controller 12 generates the signal AUDIO_TST in accordance to method 60 as will be described in more detail in connection with FIG. 3.

In operation 54, the controller 12 transmits (or sends) the signal AUDIO_TST to the audio device 14. The audio device 14 plays back audio data in response to the signal AUDIO_TST. The manner in which the controller 12 transmits the signal AUDIO_TST to the audio device 14 for playback will be described in more detail in connection with FIG. 4.

In operation 56, the controller 12 captures the audio data (e.g., via the microphone 16) from the signal AUDIO_RSP that is played back from the audio device 14. The manner in which the capture operation is performed by the controller 12 will also be described in more detail in connection with FIG. 4.

In operation 58, the controller 12 determines the frequency response and the time domain response (i.e., audio related characteristics) for the audio device 14 using the audio data from the signal AUDIO_RSP. The manner in which the frequency response and the time domain response are determined will be described in more detail in connection with FIG. 5.

Figure 3:
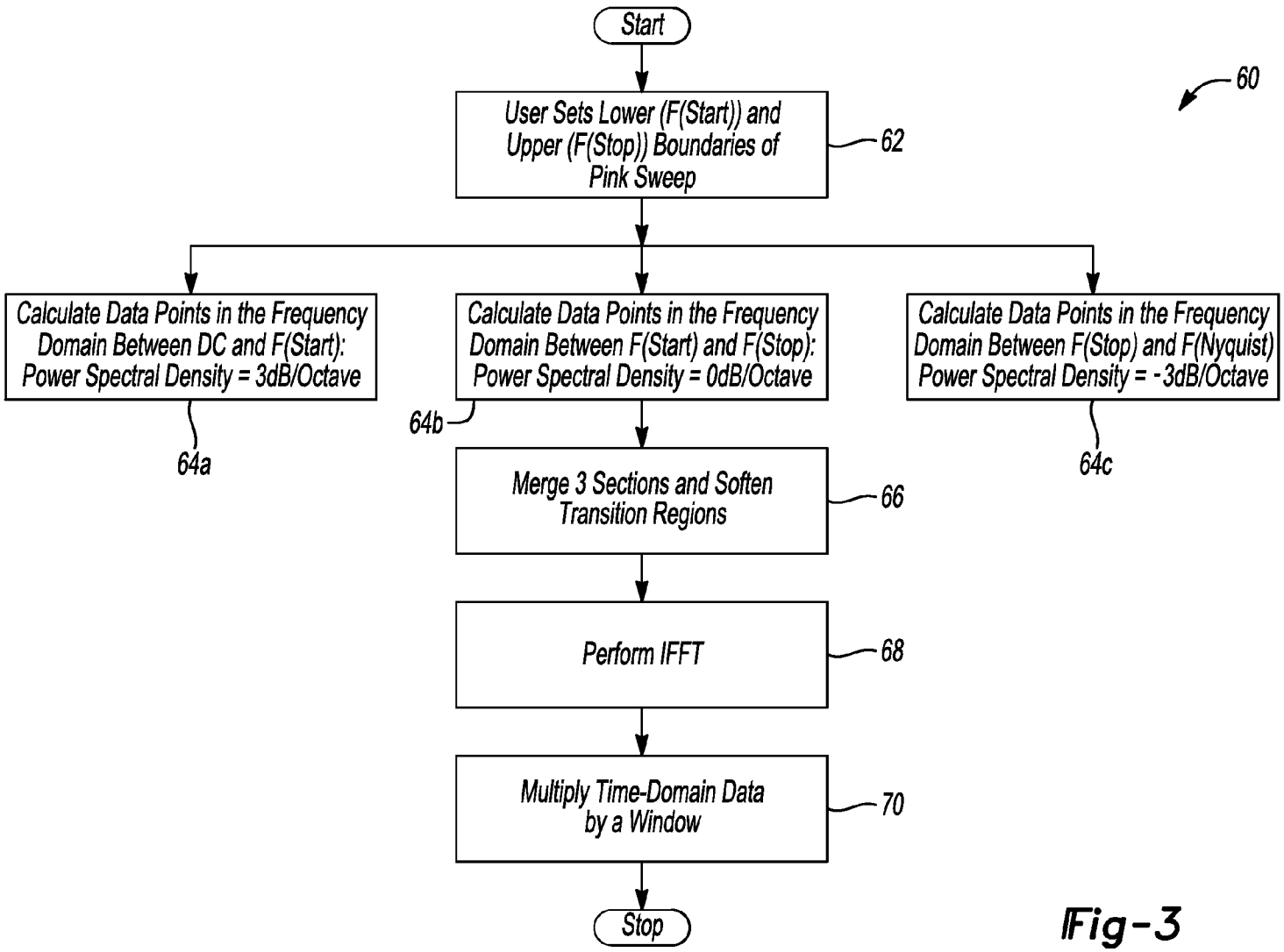
FIG. 3 depicts a method for calculating an audio test signal in accordance to one embodiment.

FIG. 3 depicts a method 60 for generating the audio test signal in accordance to one embodiment. In general, the controller 12 takes into account all applicable frequencies which comprise white, pink, and red noise sections (or spectrums) in order to generate the signal AUDIO_TST. Conventional methods generally perform a measurement sweep utilizing frequencies that generally comprise only the pink noise spectrum. In contrast, the method 60 takes into account all applicable frequencies which comprise the white, pink, and red spectrums which enables the user to obtain a full spectrum overview of the manner in which the audio device 14 operates. By taking into account all applicable frequencies which form white, pink, and red spectrums; the measurement sweep (e.g., generation of the audio test signal and playback of audio device 14 in response to the audio test signal) may maximize a signal-to-noise ratio for the shortest possible measurement time. This condition may also protect the audio device 14 from over-excursion.

In operation 62, the user inputs (or sets) a start frequency (e.g. F(start)) and a stop frequency (e.g., F(stop)) which correspond to a frequency range which forms the pink spectrum in the controller 12. For example, the controller 12 includes a user interface to receive F(start) and F(stop). Generally, the particular values used as F(start) and F(stop) vary based on the audio device 14 that is being tested. In one example, the start frequency may be 20 Hz and the stop frequency may be 20 KHz.

In operation 64*a*, the controller 12 calculates data (or data points) in the frequency domain which take into account a range of values between a DC value and the start frequency (F(start)). This frequency range generally corresponds to a group of frequencies which comprise the white spectrum. In general, the data points in the frequency domain in operation 64*a* are values that are provided on the signal AUDIO_TST for the white spectrum.

In operation 64*b*, the controller 12 calculates data (or data points) in a frequency domain which take into account the range of frequencies between F(start) and F(stop). As noted above, this frequency range generally corresponds to a group of frequencies which comprise the pink spectrum. The data points in the frequency domain in operation 64*b* are values that are provided on the signal AUDIO_TST for the pink spectrum.

In operation 64*c*, the controller 12 calculates data (or data points) in a frequency domain which take into account the range of frequencies between F(stop) and the Nyquist frequency (e.g., F(Nyquist)). This frequency range generally corresponds to a group of frequencies which comprise the red spectrum. The data points in the frequency domain in operation 64*c* are values that are provided on the signal AUDIO_TST for the red spectrum.

In operation 66, the controller 12 merges the data points as calculated in connection with operations 64*a*, 64*b*, and 64*c* to cover the entire spectrum. The controller 12 also softens the data points around the transition regions so that it is smooth and continuous.

In operation 68, the controller 12 performs an Inverse Fast Fourier Transform (IFFT) to transfer the frequencies as set forth in operations 64*a*-64*b* into the time domain.

In operation 70, the controller 12 applies a digital filter to the data as obtained in connection with operations 64*a*-64*c*. For example, the controller 12 may apply a Tukey window to the data as obtained in connection with operations 64*a*-64*c* to ensure that data on the signal AUDIO_TST starts at zero and also stops at zero in the time domain. The controller 12 transmits the signal AUDIO_TST in the time domain to the audio device 14 after operation 70 is executed.

Figure 4:
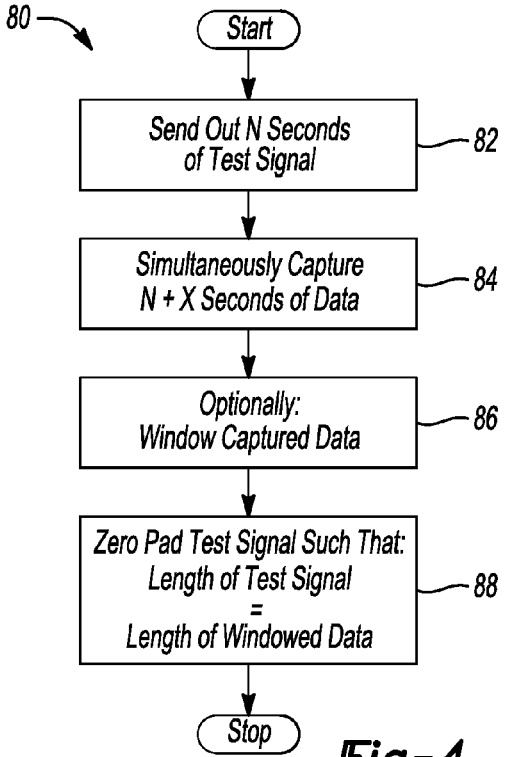
FIG. 4 depicts a method for sending the audio test signal and for capturing an audio response signal from an audio device in response to the audio test signal in accordance to one embodiment.

FIG. 4 depicts a method 80 for sending the audio test signal and for capturing the audio response signal from the audio device 14 in response to the audio test signal in accordance to one embodiment.

In operation 82, the controller 12 transmits the signal AUDIO_TST to the audio device 14 for a predetermined amount of time (e.g., N seconds). In response to receiving the signal AUDIO_TST, the audio device 14 plays back audio data (or transmits the signal AUDIO_RSP to the microphone 16).

In operation 84, the controller 12 simultaneously captures data on the signal AUDIO_RSP, via the microphone 16 for a period of time, as defined, for example by N+X, where N corresponds to the predetermined amount of time that that the controller 12 transmits the signal AUDIO_TST and X corresponds to an additional amount of time to ensure that all the sound generated by the device under test (i.e., the audio device 14) is captured. This generally includes reverberant sounds that may bounce around a room for some amount of time after the original signal has stopped.

For example, the controller 12 may additionally capture reverberation or allow for the additional time to account for the sound to travel from the audio device 14 and back to the controller 12. This may be applicable in a large concert venue setting, etc.

In operation 86, the controller 12 applies a window to the captured data from the signal the signal AUDIO_RSP. For example, the controller 12 may window the captured data to remove noise as received on the signal AUDIO_RSP.

In operation 88, the controller 12 adds a zero pad to the data on the signal AUDIO_TST or the windowed data of the signal AUDIO_RSP. For example, the controller 12 stores the length of data as transmitted on the signal AUDIO_TST in memory thereof prior to transmission. The controller 12 compares the length of data as windowed from the signal AUDIO_RSP to the length of data as transmitted on the signal AUDIO_TST. One may assume that the length of data as windowed from the signal AUDIO_RSP may be longer than the length of data as transmitted on the signal AUDIO_TST since the controller 12 is configured to capture the data on the signal AUDIO_RSP for the period of time as noted in connection with operation 84 (e.g., see variable X from operation 86 which ensures that the data is captured due to reverberation and/or distance between the controller 12 and the audio device 14, etc.).

If the length of data as windowed from the signal AUDIO_RSP is longer than the length of data as transmitted on the signal AUDIO_TST, then the controller 12 may add one or more zeros to the length of data as transmitted on the signal AUDIO_TST. For example, assume that the length of data as windowed from the signal AUDIO_RSP is 5 seconds and that the length of data as transmitted on the signal AUDIO_TST is 4 seconds, the controller 12 then adds one or more zeros (i.e., zero pad) to the length of data as transmitted on the signal AUDIO_TST that is equivalent to one additional second such that the length is similar. This operation is performed to enable the windowed data from the signal AUDIO_RSP to be divided by the zero padded data of the signal AUDIO_TST (see operation 96 in FIG. 5). In general, the length of the captured data is equal to or greater than the length of data on the signal AUDIO_TST. As such, the zero padded data (or zero(s)) is added to the end of the data on the signal AUDIO_TST.

Figure 5:
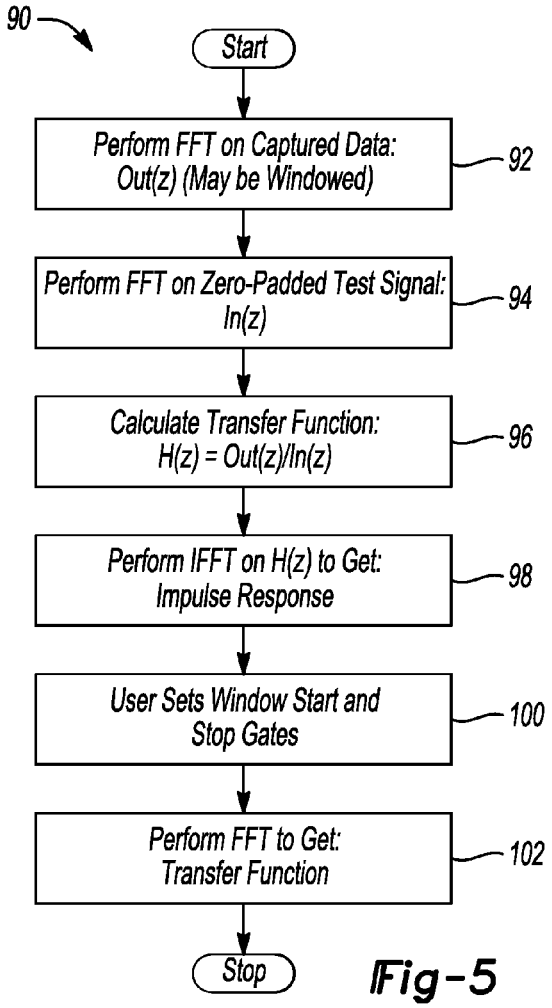
FIG. 5 depicts a method for calculating a response for the audio device in accordance to one embodiment.

FIG. 5 depicts a method 90 for calculating a response for the audio device 14 in accordance to one embodiment.

In operation 92, the controller 12 performs FFT on the data from the signal AUDIO_RSP to place such data in the frequency domain. The frequency based data from the signal AUDIO_RSP may be generally defined as Out(z). The data on the signal AUDIO_RSP may be windowed as noted in connection with operation 86 above. It is further recognized that the data on the signal AUDIO_RSP may not be windowed.

In operation 94, the controller 12 performs FFT on the zero-padded data of the signal AUDIO_TST to place such data in the frequency domain. The frequency based data from the signal AUDIO_TST may be generally defined as In(z).

In operation 96, the controller 12 calculates a transfer function for the audio device 14 with the following equation:

$$H(z)=\mathrm{Out}(z)/\mathrm{In}(z) \quad \text{(Eq. 1)}$$

where H(z) is the transfer function (or the frequency response) for the audio device 14.

In operation 98, the controller 12 performs IFFT on H(z) to obtain an impulse response (e.g., to obtain the response in the time domain for the audio device 14).

In operation 100, the controller 12 enables the user to establish window start and stop gates. For example, the user may inspect where the impulse response starts and where the impulse response drops into the noise floor of the measurement. In general, the impulse response "rises above the noise floor" for only a small portion of the total time domain. Therefore, if the sections of the time domain data that are only noise are replaced with zeros, a cleaner frequency domain representation may be provided with the FFT (i.e., an FFT is performed on the impulse response and zeros, not the impulse response and noise).

In operation 102, the controller 12 performs FFT on the impulse response interval as established in operation 100 to provide the user with information related to audio device 14 in the frequency domain. In general, this information in the frequency domain provides a new transfer function that is less noisy than the transfer function provided in connection with operation 96.

The transfer function as provided in connection with operation 102 may enable the user to determine whether the audio device 14 requires equalization (e.g., by creating and applying a set of filters). In one example, the impulse response function as provided in connection with operation 98 may enable the user to determine a distance between the audio device 14 and the microphone 16.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus for performing an audio measurement, the apparatus comprising:

a memory device; and a controller including the memory device and being programmed to:

generate an audio test signal based on a first frequency range that comprises a first noise spectrum, a second frequency range that comprises a second noise spectrum, and a third frequency range that comprises a third noise spectrum;

transmit the audio test signal to an audio device that generates an audio response signal responsive to the audio test signal;

receive the audio response signal from a microphone;

determine audio related characteristics for the audio device in response to the audio response signal; and merge the first frequency range, the second frequency range, and the third frequency range together on the audio test signal prior to transmitting the audio test signal.

2. The apparatus of claim 1 wherein the first noise spectrum comprises a white noise spectrum.

3. The apparatus of claim 2 wherein the second noise spectrum comprises a pink noise spectrum.

4. The apparatus of claim 3 wherein the third noise spectrum comprises a red noise spectrum.

5. The apparatus of claim 1 wherein the audio related characteristics comprise a frequency response and a time domain response.

6. The apparatus of claim 1 wherein the controller is further programmed to convert first frequencies within the first frequency range, second frequencies within the second frequency range, and third frequencies within the third frequency range into a time domain prior to transmitting the audio test signal to the audio device.

7. The apparatus of claim 6 wherein the controller is further programmed to perform an Inverse Fast Fourier Transform (IFFT) on the first frequencies, the second frequencies, and the third frequencies for conversion into the time domain.

8. The apparatus of claim 6 wherein the controller is further programmed to apply a digital filter to the first frequencies, the second frequencies, and the third frequencies such that data on the audio test signal starts at zero and ends at zero prior to transmitting the audio test signal to the audio device.

9. A computer-program product embodied in a non-transitory computer read-able medium that is programmed to perform an audio measurement, the computer-program product comprising instructions to:

generate an audio test signal based on at least one of a first frequency range of a noise spectrum, a second frequency range of a noise spectrum, and a third frequency range of a noise spectrum;

transmit the audio test signal to a loudspeaker that generates an audio response signal responsive to the audio test signal;

receive the audio response signal from a microphone;

determine audio related characteristics for the loudspeaker in response to the audio response signal;

convert (i) first frequencies within the first frequency range, (ii) second frequencies within the second frequency range, and (iii) third frequencies within the third frequency range into a time domain prior to transmitting the audio test signal to the loudspeaker; and apply a digital filter to the first frequencies, the second frequencies, and the third frequencies such that data on the audio test signal starts at zero and ends at zero prior to transmitting the audio test signal to the loudspeaker.

10. The computer-program product of claim 9 further comprising instructions to generate the audio test signal based on the first frequency range of a white noise spectrum.

11. The computer-program product of claim 10 further comprising instructions to generate the audio test signal based on the second frequency range of a pink noise spectrum.

12. The computer-program product of claim 11 further comprising instructions to generate the audio test signal based on the third frequency range of a red noise spectrum.

13. The computer-program product of claim 12 wherein the audio related characteristics comprise a frequency response and a time domain response.

14. The computer-program product of claim 12 further comprising instructions to merge the first frequency range, the second frequency range, and the third frequency range together on the audio test signal prior to transmitting the audio test signal.

15. The computer-program product of claim 9 further comprising instructions to perform an Inverse Fast Fourier Transform (IFFT) on the first frequencies, the second frequencies, and the third frequencies for conversion into the time domain.

16. An apparatus comprising:

a loudspeaker configured to:

output an audio response signal responsive to an audio test signal that is based on a first frequency range that comprises a first noise spectrum, a second frequency range that comprises a second noise spectrum, and a third frequency range that comprises a third noise spectrum; and transmit the audio response signal; and a controller including a memory device and being configured to:

transmit the audio test signal to the loudspeaker, merge the first frequency range, the second frequency range, and the third frequency range together on the audio test signal prior to transmitting the audio test signal, and determine audio related characteristics for the loudspeaker in response to the audio response signal.

17. The apparatus of claim 16 wherein the audio related characteristics comprise a frequency response and a time domain response.

18. The apparatus of claim 16 wherein the first noise spectrum comprises a white noise spectrum, the second noise spectrum comprises a pink spectrum, and the third noise spectrum comprises a red spectrum.

* * * * *